US007682417B2

(12) United States Patent
Schemmel et al.

(10) Patent No.: US 7,682,417 B2
(45) Date of Patent: Mar. 23, 2010

(54) COLD WORK STEEL ARTICLE

(75) Inventors: Ingrid Schemmel, Oberaich (AT); Stefan Marsoner, Graz (AT); Werner Liebfahrt, Kapfenberg (AT)

(73) Assignee: Bohler Edelstahl GmbH, Kapfenberg (AT)

( * ) Notice: Subject to any disclaimer, the term of this patent is extended or adjusted under 35 U.S.C. 154(b) by 1521 days.

(21) Appl. No.: 10/830,003

(22) Filed: Apr. 23, 2004

(65) Prior Publication Data

US 2005/0002819 A1 Jan. 6, 2005

(30) Foreign Application Priority Data

Apr. 24, 2003 (AT) ..... A 627/2003

(51) Int. Cl.
*B22F 9/00* (2006.01)
*C22C 5/00* (2006.01)

(52) U.S. Cl. ..... 75/246; 75/338; 419/14; 419/68; 420/109

(58) Field of Classification Search ..... 75/246, 75/255, 231, 338; 419/23, 24, 14, 68; 148/330–333; 420/109

See application file for complete search history.

(56) References Cited

U.S. PATENT DOCUMENTS

| | | | |
|---|---|---|---|
| 5,522,914 | A | 6/1996 | Stasko et al. |
| 5,753,005 | A | 5/1998 | Aoki et al. |
| 2003/0095886 | A1 | 5/2003 | Maili et al. |

FOREIGN PATENT DOCUMENTS

| | | | |
|---|---|---|---|
| EP | 0648851 | | 4/1995 |
| EP | 1249511 | | 10/2002 |
| JP | 62-250158 | | 10/1987 |
| JP | 3-236445 | | 10/1991 |
| JP | 4-180541 | | 6/1992 |
| JP | 6-246338 | | 9/1994 |
| JP | 7-316739 | | 12/1995 |
| JP | 8-100239 | | 4/1996 |
| JP | 2003055747 | A * | 2/2003 |

OTHER PUBLICATIONS

Official Translation of Yoshimoto et al. (JP 2003055747 A).*
English Language Abstract of JP 7-316739.
English Language Abstract of JP 62-250158.
English Language Abstract of JP 6-246338.
English Language Abstract of JP 8-100239.
English Language Abstract of JP 3-236445.
English Language Abstract of JP 4-180541.

* cited by examiner

*Primary Examiner*—George Wyszomierski
*Assistant Examiner*—Weiping Zhu
(74) *Attorney, Agent, or Firm*—Greenblum & Bernstein, P.L.C.

(57) ABSTRACT

A cold work steel article. The article comprises a material which comprises, in addition to Fe, the elements C, Si, Mn, P, S, Cr, Mo, Ni, V, W, Cu, Co, Al, N and O in certain concentrations and has been produced by by a powder metallurgical process. This abstract is neither intended to define the invention disclosed in this specification nor intended to limit the scope of the invention in any way. This abstract is neither intended to define the invention disclosed in this specification nor intended to limit the scope of the invention in any way.

39 Claims, 1 Drawing Sheet

COLD WORK STEEL ARTICLE

CROSS-REFERENCE TO RELATED APPLICATIONS

The present application claims priority under 35 U.S.C. §119 of Austrian Patent Application No. A 627/2003, filed on Apr. 24, 2003, the disclosure of which is expressly incorporated by reference herein in its entirety.

BACKGROUND OF THE INVENTION

1. Field of the Invention

The present invention relates to a cold work steel article. More precisely, the present invention relates to a cold work steel article with an improved property profile, in particular, with high strength and high ductility.

2. Discussion of Background Information

For a cold massive forming, e.g., with extrusion molding dies and dies for producing components and also for cutting tools with additional high demands regarding the toughness of the material, such as tap drills and the like, articles having an overall high property level of the material are required in modern technology. This is also caused by the expenditure entailed by tool production, because a complicated geometry of a component to be manufactured usually translates into high costs for the production of the corresponding tool.

This requirement should be seen primarily in terms of an improved economic efficiency in a large-scale production of parts or components. In order to keep the overall costs low, a material for the part for the respective use should be selected which due to the material properties, allows to obtain the longest possible service life of the part.

To improve the service life of a cold work steel article which is subjected to overall high stress during the use thereof, the material should have a high ductility to prevent tool breakages, and a high strength to ensure an accuracy with respect to size. Also, wear should be minimized.

Iron-based materials with a high carbide content, in particular, with a high monocarbide content in a hard matrix, exhibit increased resistance to abrasive wear. Such steels usually have a high carbon content of up to 2.5% by weight and a concentration of monocarbide-forming elements of up to 15% by weight, i.e., a high primary carbide content. However, they exhibit a low toughness in a heat-treated state. The microstructure, in particular, the carbide size and the carbide distribution in the material of the article can be improved by a powder metallurgical production, but in many cases the required toughness of the material can still not be achieved.

Improved toughness properties can be achieved with typical highly alloyed high-speed steel materials, e.g., those according to DIN (German Industrial Standard) material no. 1.3351, with powder metallurgical production of the parts, but this increase in the toughness of the material is not sufficient for particularly stressed articles, so that in long-term operation a breakdown often occurs by breakage of the same.

It would be desirable to have available a cold work steel article whose material exhibits increased toughness and compressive strength, high wear-resistance and hardness, and an improved fatigue resistance. In other words, it would be desirable to provide a cold work steel article with both high strength and ductility, which article, in particular in the form of matrices and dies, offers a high economic efficiency in a large-scale production of parts.

SUMMARY OF THE INVENTION

The present invention provides a cold work steel article. The article comprises a material having a composition, by weight, of from more than about 0.6 % to less than about 1.0% of C, from more than about 0.3% to less than about 0.85% of Si, from more than about 0.2% to less than about 1.5% of Mn, up to about 0.03% of P, less than about 0.5% of S, from more than about 4.0% to less than about 6.2% of Cr, from more than about 1.9% to less than about 3.8% of Mo, less than about 0.9% of Ni, from more than about 1.0% to less than about 2.9% of V, from more than about 1.8% to less than about 3.4% of W, less than about 0.7% of Cu, from more than about 3.8% to less than about 5.8% of Al, less than about 0.065% of Al, less than about 0.2% of N, up to about 0.012% of O, with the balance being iron and accompanying and impurity elements due to smelting. The material is produced by a powder metallurgical process. The weight percentages given herein and in the appended claims are based on the total weight of the material.

In one aspect of the article, the article, when subjected to a heat treatment to a hardness of about 64 HRC, may have an impact strength at room temperature of higher than about 40 J, e.g., higher than about 80 J, or higher than about 100 J.

In another aspect of the article, one or more (e.g., all) elements in the material may be present in the following concentrations by weight: from more than about 0.75% to less than about 0.94% of C, from more than about 0.35% to less than about 0.7% of Si, from more than about 0.25% to less than about 0.9% of Mn, up to about 0.025% of P, less than about 0.34% of S, from more than about 0.4% to less than about 5.9% of Cr, from more than about 2.2% to less than about 3.4% of Mo, less than about 0.5% of Ni, from more than about 1.5% to less than about 2.6% of V, from more than about 2.0 % to less than about 3.0% of W, less than about 0.45% of Co, from more than about 4.0 % to less than about 5.0% of Co, less than about 0.05% of Al, from more than about 0.01% to less than about 0.1% of N, up to about 0.010% of O. For example, one or more (e.g., all) elements in the material may be present in the following concentrations by weight: from more than about 0.8% to less than about 0.9% of C, from more than about 0.4% to less than about 0.65% of Si, from more than about 0.3% to less than about 0.5% of Mn, up to about 0.025% of P, up to about 0.025% of S, from more than about 4.1% to less than about 4.5% of Cr, from more than about 2.5% to less than about 3.0% of Mo, less than about 0.5% of Ni, from more than about 1.8% to less than about 2.4% of V, from more than about 2.0% to less than about 3.0% of W, up to about 0.3% of Cu, from more than about 4.2% to less than about 4.8% of Co, from more than about 0.01% to less than about 0.045% of Al, from more than about 0.05% to less than about 0.08% of N, up to about 0.009% of O.

In yet another aspect of the article of the present invention, one or more (e.g., all) of the following impurity elements in the material may be present in the following concentrations by weight: not more than about 0.02% of Sn, not more than about 0.022 % of Sb, not more than about 0.03% of As, not more than about 0.012% of Se, not more than about 0.01 of Bi.

In a still further aspect of the article, the article may have a pressure yielding point at a hardness of about 61 HRC of higher than about 2,700 MPa.

In another aspect of the article, the powder metallurgical process may comprise an atomization of the melt with nitrogen to produce a metal powder having a grain size of not larger than about 500 μm. Further, the powder metallurgical process may further comprise placing the metal powder into a vessel while avoiding oxygen admission, closing the vessel and hot isostatically pressing the metal powder in the closed vessel to produce a blank. The blank may then be further processed by hot forming.

The present invention also provides a process for producing a cold work steel article. The process comprises the steps of making a blank of a metal material by a powder metallurgical process and converting the blank into the article. The metal material is the material recited above, including the various aspects thereof.

In one aspect of the process, the article, when subjected to a heat treatment to a hardness of about 64 HRC, may have an impact strength at room temperature of higher than about 40 J, e.g., higher than about 80 J, or higher than about 100 J.

In another aspect of the process, the article may have a pressure yielding point at a hardness of about 61 HRC of higher than about 2,700 MPa.

In yet another aspect, the powder metallurgical process may comprise the steps of atomizing the melt with nitrogen (preferably, nitrogen of high purity) to produce a metal powder having a powder grain size of not larger than about 500 μm. In a still further aspect, the powder metallurgical process may further comprise placing the metal powder into a vessel while avoiding oxygen admission, closing the vessel and hot isostatically pressing the metal powder in the closed vessel to produce the blank. In another aspect, the blank may be further processed by hot forming. In a still further aspect, The present invention also provides a metal material for producing a cold work steel article by a powder metallurgical process and a metal powder comprising this material. The material is the one recited above, including the various aspects thereof.

In one aspect of the metal powder, the metal powder may have a grain size of not larger than about 500 μm. Also, the metal powder may have been produced by a atomization of a metal melt with an inert gas, e.g., a gas comprising nitrogen.

The chemical composition of material of the article according to the present invention and the powder metallurgical production thereof synergistically provide a cold work steel article which after a heat treatment thereof, exhibits a desirable property profile.

In the chemical composition of the material of the article, the activities of the alloying elements are coordinated with one another in terms of kinetic effect with regard to a microstructural arrangement in the heat-treated state and to required properties of the material.

The carbon content of the material is determined by the sum of the carbide formers in the alloy in order on the one hand to form carbides and on the other hand to establish the hardenability and the desired properties of the matrix. Concentrations of carbon of more than about 0.6% by weight are desirable in order to achieve high hardness values of the matrix during a heat treatment with the provided maximum contents of the carbide-forming elements. However, contents of less than about 1.0% by weight are usually required in order to adjust the desired carbide concentration and carbide morphology.

The carbide-forming elements chromium (Cr), molybdenum (Mo), vanadium (V) and tungsten (W) are considered together in terms of alloying technology, because their total carbon activity, as has been shown, determines the composition of the austenitic or cubic face-centered atomic structure at the hardening temperature and consequently, the matrix properties and the secondary carbide precipitations after an at least one-time tempering.

According to the present invention, the vanadium content of the alloy should be greater than about 1.0% but less than about 2.9% by weight, in order on the one hand to produce sufficient monocarbides and on the other hand to produce sufficient secondary hardening potential. The secondary hardening potential must be considered in relation to a residual vanadium and the concentrations of the elements molybdenum (Mo) and tungsten (W). In particular, a deterioration of the toughness of the matrix may be caused already by concentrations of as little as about 3.8% by weight of molybdenum (Mo) and about 3.4% by weight of tungsten (W). However, concentrations of greater than about 1.9% by weight of molybdenum (Mo) and about 1.8% by weight of tungsten (W) are desirable for an advantageous masking of vanadium, to thereby avoid the formation of large sharp-edged monocarbides.

For the interaction of the elements it can also be advantageous for the concentration of molybdenum to be not higher than that of tungsten (W) by more than about 10% by weight.

The elements chromium (Cr), silicon (Si), manganese (Mn) and, to a small extent, nickel (Ni) and cobalt (Co) are important for a hardness acceptance and a hardenability throughout of the material.

Silicon contents of more than about 0.3% by weight are desirable to ensure low oxygen contents in the material. However, less than about 0.85% by weight of silicon should usually be provided in the alloy in order to counteract a ferrite-stabilizing effect and a reduction of the hardness acceptance of the matrix by this element.

According to the invention, manganese is an important element for regulating a required cooling rate during the hardening of the article and should preferably be present in the material in a concentration of less-than about 1.5% by weight. However, because small concentrations of manganese are necessary for binding residual sulfur in the alloy, a minimal concentration of more than about 0.2% by weight should be provided.

In order not to undesirably influence a martensite formation during the cooling from a hardening temperature, nickel contents of less than about 0.9% by weight should be provided in the material.

While cobalt is effective with respect to the heat treatment technology to be used, according to the invention this effect is taken into account in terms of alloying technology. A concentration in the matrix of more than about 3.8% and less than about 5.8% by weight of cobalt is preferred for obtaining a high hardness by a mixed-crystal strengthening of the material. According to the present invention, cobalt affects the kinetics and the size of secondary carbide precipitations in a favorable manner with respect to the properties of the material. Very fine carbides which produce the secondary hardness are formed and their tendency to coarsening is reduced, which results in a substantially delayed softening of the heat-treated alloy by elevated temperatures. Lower cobalt contents than about 3.8% by weight usually reduce the hardness and the fatigue resistance of the material. On the other hand, cobalt values of about 5.8% by weight and higher tend to reduce, in particular, the toughness of the material.

It is known that aluminum can in part act as a substitute for cobalt and increases the cutting capacity of high-speed steels. The aluminum content in the alloy should usually be less than 0.065% by weight due to a tendency towards nitride formation and a simple atomizing technology and a low nitrogen concentration in the metal of less than about 0.2% by weight.

Oxygen concentrations of more than about 0.012% by weight tend to reduce the mechanical properties of the material according to the invention even when PM technology is employed.

Phosphorus contents of more than about 0.03% by weight frequently impair the ease of fabrication.

According to the invention a powder metallurgical production of the cold work steel article is advantageous for achieving particularly desirable mechanical properties of the material, in particular a high strength and a high ductility. The formation by means of alloying technology of essentially spherical primary carbides which exhibit a small diameter and a high degree of purity in combination with a favorable microstructure formation of the material, allow to avoid a crack initiation which is usually caused by sharp-edged carbide particles and impurity particles. In this manner, a high impact strength of the material and a favorable fatigue resistance of the steel article in use can be achieved in combination with a high material hardness.

The use properties of a cold work steel article according to the invention can be further improved if one or more of the elements are present in the material in a concentration in % by weight of:

| | |
|---|---|
| Carbon (C) | more than about 0.75 and less than about 0.94 in particular, more than about 0.8 and less than about 0.9 |
| Silicon (Si) | more than about 0.35 and less than about 0.7 in particular, more than about 0.4 and less than about 0.65 |
| Manganese (Mn) | more than about 0.25 and less than about 0.9 in particular, more than about 0.3 and less than about 0.5 |
| Phosphorus (P) | max. about 0.025 |
| Sulfur (S) | less than about 0.34 in particular, max. about 0.025 |
| Chromium (Cr) | more than about 0.4 and less than about 5.9 in particular, more than about 4.1 and less than about 4.5 |
| Molybdenum (Mo) | more than about 2.2 and less than about 3.4 in particular, more than about 2.5 and less than about 3.0 |
| Nickel (Ni) | less than about 0.5 |
| Vanadium (V) | more than about 1.5 and less than about 2.6 in particular, more than about 1.8 and less than about 2.4 |
| Tungsten (W) | more than about 2.0 and less than about 3.0 |
| Copper (Cu) | less than about 0.45 in particular, max. about 0.3 |
| Cobalt (Co) | more than about 4.0 and less than about 5.0 in particular, more than about 4.2 and less than about 4.8 |
| Aluminum (Al) | less than about 0.05 in particular, more than about 0.01 and less than about 0.045 |
| Nitrogen (N) | more than about 0.01 and less than about 0.1 in particular, more than about 0.05 and less than about 0.08 |
| Oxygen (O) | max. about 0.01 in particular, max. about 0.09. |

It is particularly advantageous for high toughness values and good fatigue resistance properties of the article if one or more impurity elements in the material are present in a concentration in % by weight of:

| | |
|---|---|
| Tin (Sn) | max. about 0.02 |
| Antimony (Sb) | max. about 0.022 |
| Arsenic (As) | max. about 0.03 |
| Selenium (Se) | max about 0.012 |
| Bismuth (Bi) | max. about 0.01. |

The purity and thus also the mechanical properties of the material, in particular the toughness, can be improved if the powder metallurgical process comprises atomizing the melt with high-purity nitrogen to produce a metal powder with a grain size of not higher than 500 μm, followed by essentially placing the powder into a vessel while avoiding oxygen admission and by a high-temperature isostatic pressing of the metal powder in the closed vessel to produce a blank.

For an economic production of a cold work steel article, but also because of the material properties, it can be advantageous to further process the high-temperature isostatically pressed blank by hot forming.

If the cold work steel article has a pressure yielding point of more than about 2,700 MPa, determined at a hardness of about 61 HRC, very reliable extrusion molding dies for complicated, finely structured molded parts can be produced, which dies show low surface wear and a low propensity to crack formation even in long-term operation.

According to the invention, for use in long-term hard stamping with intermittent stress, after a heat treatment to a hardness of about 64 HRC the present cold work steel article may advantageously have an impact strength at room temperature of greater than about 80 joule (J), preferably greater than about 100 joule.

BRIEF DESCRIPTION OF THE DRAWINGS

The present invention is further described in the detailed description which follows, in reference to the drawing wherein.

DETAILED DESCRIPTION OF THE PRESENT INVENTION

Figure 1:
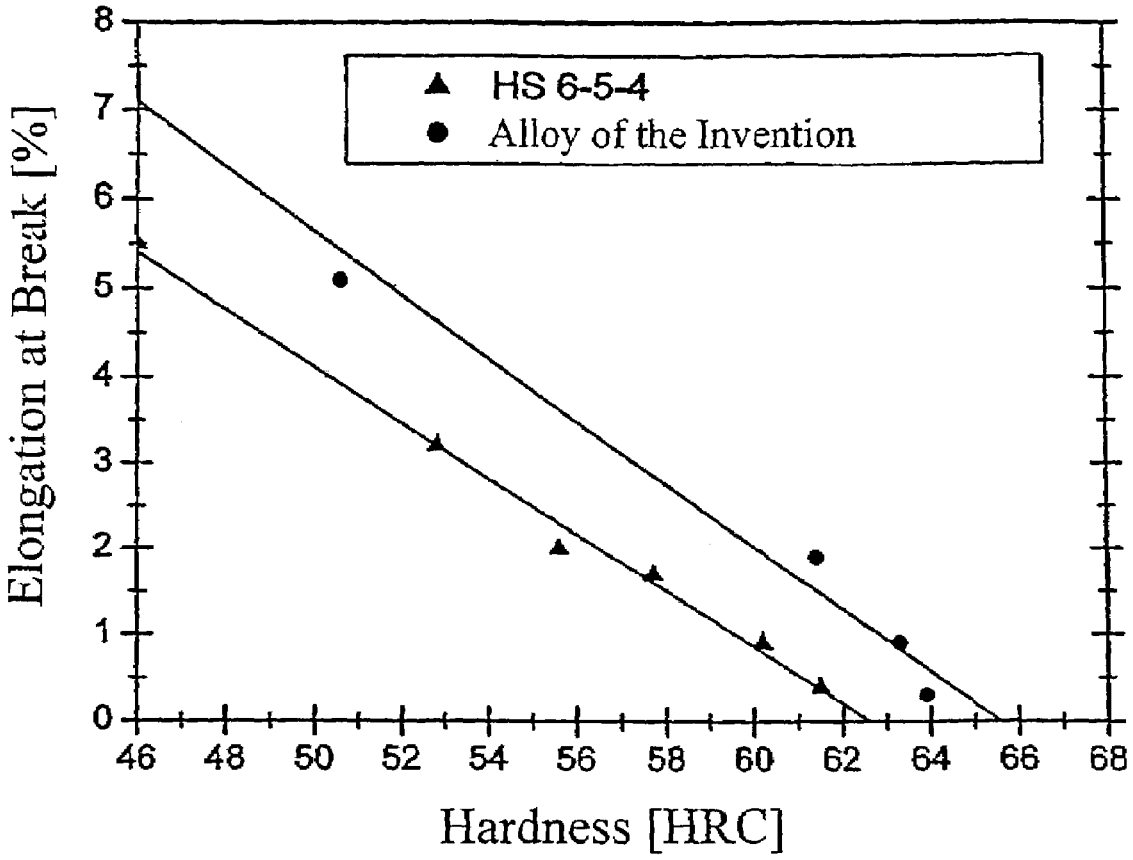
FIG. 1 is a graph showing the elongation at break of a material according to the invention and of a comparison material as a function of the hardness.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawing making apparent to those skilled in the art how the several forms of the present invention may be embodied in practice.

To characterize the article according to the invention, the impact strength at room temperature according to DIN 51222 of un-notched samples (7×10×55 mm) was used, because the corresponding values permit a precise evaluation of the toughness behavior.

To determine the elongation at break and the plastic work from the static uniaxial tensile test, special tensile samples with clamping heads in a spherical shape with a progressively enlarged diameter were used, wherein the clamping device in the testing machine took into account the ball head geometry. Such tests are described in the literature ($6^{th}$ International Tooling Conference, The Use of Tool Steels: Experience and Research, Karlstad University 10-13 Sep. 2002, Material Behaviour of Powder-Metallurgically Processed Tool Steels in Tensile and Bending Tests, page 169-178, the entire disclosure whereof is incorporated by reference herein).

The 0.2% strain limit of the material was determined in a compression test according to DIN 50106 at room temperature.

A abrasion wear test was carried out with SiC abrasive paper P 120.

The above tests utilize different methods for characterizing the strength and ductility of metallic materials. The most informative test is the uniaxial tensile test. Essential strength and ductility characteristic values can be determined with this test. Moreover, this test permits to obtain data regarding the strengthening behavior of the materials under uniaxial tensile stress.

FIG. 1 shows the elongation at break of a material according to the present invention and of a high-speed steel comparison material (HS-6-5-4) as a function of the material hardness as adjusted by a heat treatment, using the samples described above.

The elongation at break of the alloy according to the invention is higher throughout the entire hardness range of the material than that of the comparison steel, and is up to about 4 times higher than that of the comparison in the upper hardness range of 58 HRC to 62 HRC.

Compared with the prior art, the advantageous combination of properties of high strength and high ductility of the material according to the invention is particularly apparent in the determination of the plastic work by the static uniaxial tensile test. With essentially the same tempering condition and at a material hardness of 63 HRC, the plastic work in the tensile test material according to the invention at room temperature was determined to be about 20% higher than that of the comparison. At a material hardness of 61.5 HRC (Rockwell Hardness C), an increase in the plastic work of about. 50% was determined when using the high-speed steels HS-10-2-5-8-PM and HS-6-5-3-PM produced by powder metallurgy as comparison materials.

In addition to the outstanding combination of the strength and ductility properties, as shown above, the alloy according to the invention exhibited a very good abrasive wear resistance, as determined in the SiC abrasive paper test. This property was achieved despite a primary carbide content that was lower than that of standard PM alloys which are used in this field of application.

The average wear value for the given alloys is 7 $g^{-1}$ at a hardness of 61 HRC.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A cold work steel article, wherein the article comprises a material having a composition, in % by weight, of:

| | |
|---|---|
| Carbon | from more than about 0.6 to less than about 1.0 |
| Silicon | from more than about 0.3 to less than about 0.85 |
| Manganese | from more than about 0.2 to less than about 1.5 |
| Phosphorus | from 0 to about 0.03 |

-continued

| | |
|---|---|
| Sulfur | from 0 to less than about 0.5 |
| Chromium | from more than about 4.0 to less than about 6.2 |
| Molybdenum | from more than about 1.9 to less than about 3.8 |
| Nickel | from 0 to less than about 0.9 |
| Vanadium | from more than about 1.0 to less than about 2.9 |
| Tungsten | from more than about 1.8 to less than about 3.4 |
| Copper | from 0 to less than about 0.7 |
| Cobalt | from more than about 3.8 to less than about 5.8 |
| Aluminum | from 0 to less than about 0.065 |
| Nitrogen | from 0 to less than about 0.2 |
| Oxygen | from 0 to about 0.012 |

the balance being iron and accompanying and impurity elements due to smelting, the material produced by a powder metallurgical process.

2. The article of claim 1, wherein the article, when subjected to a heat treatment to a hardness of about 64 HRC, has an impact strength at room temperature of higher than about 40 J.

3. The article of claim 1, wherein one or more elements in the material are present in the following concentrations:

| | |
|---|---|
| Carbon | from more than about 0.75 to less than about 0.94 |
| Silicon | from more than about 0.35 to less than about 0.7 |
| Manganese | from more than about 0.25 to less than about 0.9 |
| Phosphorus | from 0 to about 0.025 |
| Sulfur | from 0 to less than about 0.34 |
| Chromium | from more than about 4.0 to less than about 6.2 |
| Molybdenum | from more than about 2.2 to less than about 3.4 |
| Nickel | from 0 to less than about 0.5 |
| Vanadium | from more than about 1.5 to less than about 2.6 |
| Tungsten | from more than about 2.0 to less than about 3.0 |
| Copper | from 0 to less than about 0.45 |
| Cobalt | from more than about 4.0 to less than about 5.0 |
| Aluminum | from 0 to less than about 0.05 |
| Nitrogen | from more than about 0.01 to less than about 0.1 |
| Oxygen | from 0 to about 0.010. |

4. The article of claim 1, wherein the elements in the material are present in the following concentrations:

| | |
|---|---|
| Carbon | from more than about 0.75 to less than about 0.94 |
| Silicon | from more than about 0.35 to less than about 0.7 |
| Manganese | from more than about 0.25 to less than about 0.9 |
| Phosphorus | from 0 to about 0.025 |
| Sulfur | from 0 to less than about 0.34 |
| Chromium | from more than about 4.0 to less than about 6.2 |
| Molybdenum | from more than about 2.2 to less than about 3.4 |
| Nickel | from 0 to less than about 0.5 |
| Vanadium | from more than about 1.5 to less than about 2.6 |
| Tungsten | from more than about 2.0 to less than about 3.0 |
| Copper | from 0 to less than about 0.45 |
| Cobalt | from more than about 4.0 to less than about 5.0 |
| Aluminum | from 0 to less than about 0.05 |
| Nitrogen | from more than about 0.01 to less than about 0.1 |
| Oxygen | from 0 to about 0.010. |

5. The article of claim 1, wherein one or more elements in the material are present in the following concentrations:

| | |
|---|---|
| Carbon | from more than about 0.8 to less than about 0.9 |
| Silicon | from more than about 0.4 to less than about 0.65 |
| Manganese | from more than about 0.3 to less than about 0.5 |
| Phosphorus | from 0 to about 0.025 |
| Sulfur | from 0 to about 0.025 |
| Chromium | from more than about 4.1 to less than about 4.5 |

-continued

| | |
|---|---|
| Molybdenum | from more than about 2.5 to less than about 3.0 |
| Nickel | from 0 to less than about 0.5 |
| Vanadium | from more than about 1.8 to less than about 2.4 |
| Tungsten | from more than about 2.0 to less than about 3.0 |
| Copper | from 0 to about 0.3 |
| Cobalt | from more than about 4.2 to less than about 4.8 |
| Aluminum | from more than about 0.01 to less than about 0.045 |
| Nitrogen | from more than about 0.05 to less than about 0.08 |
| Oxygen | from 0 to about 0.009. |

6. The article of claim 1, wherein the elements in the material are present in the following concentrations:

| | |
|---|---|
| Carbon | from more than about 0.8 to less than about 0.9 |
| Silicon | from more than about 0.4 to less than about 0.65 |
| Manganese | from more than about 0.3 to less than about 0.5 |
| Phosphorus | from 0 to about 0.025 |
| Sulfur | from 0 to about 0.025 |
| Chromium | from more than about 4.1 to less than about 4.5 |
| Molybdenum | from more than about 2.5 to less than about 3.0 |
| Nickel | from 0 to less than about 0.5 |
| Vanadium | from more than about 1.8 to less than about 2.4 |
| Tungsten | from more than about 2.0 to less than about 3.0 |
| Copper | from 0 to about 0.3 |
| Cobalt | from more than about 4.2 to less than about 4.8 |
| Aluminum | from more than about 0.01 to less than about 0.045 |
| Nitrogen | from more than about 0.05 to less than about 0.08 |
| Oxygen | from 0 to about 0.009. |

7. The article of claim 4, wherein one or more elements in the material are present in the following concentrations:

| | |
|---|---|
| Carbon | from more than about 0.8 to less than about 0.9 |
| Silicon | from more than about 0.4 to less than about 0.65 |
| Manganese | from more than about 0.3 to less than about 0.5 |
| Sulfur | from 0 to about 0.025 |
| Chromium | from more than about 4.1 to less than about 4.5 |
| Molybdenum | from more than about 2.5 to less than about 3.0 |
| Vanadium | from more than about 1.8 to less than about 2.4 |
| Copper | from 0 to about 0.3 |
| Cobalt | from more than about 4.2 to less than about 4.8 |
| Aluminum | from more than about 0.01 to less than about 0.045 |
| Nitrogen | from more than about 0.05 to less than about 0.08 |
| Oxygen | from 0 to about 0.009. |

8. The article of claim 1, wherein one or more impurity elements in the material are present in the following concentrations in % by weight:

| | |
|---|---|
| Tin | 0 to not more than about 0.02 |
| Antimony | 0 to not more than about 0.022 |
| Arsenic | 0 to not more than about 0.03 |
| Selenium | 0 to not more than about 0.012 |
| Bismuth | 0 to not more than about 0.01. |

9. The article of claim 3, wherein one or more impurity elements in the material are present in the following concentrations in % by weight:

| | |
|---|---|
| Tin | 0 to not more than about 0.02 |
| Antimony | 0 to not more than about 0.022 |
| Arsenic | 0 to not more than about 0.03 |
| Selenium | 0 to not more than about 0.012 |
| Bismuth | 0 to not more than about 0.01. |

10. The article of claim 6, wherein impurity elements in the material are present in the following concentrations in % by weight:

| | |
|---|---|
| Tin | 0 to not more than about 0.02 |
| Antimony | 0 to not more than about 0.022 |
| Arsenic | 0 to not more than about 0.03 |
| Selenium | 0 to not more than about 0.012 |
| Bismuth | 0 to not more than about 0.01. |

11. The article of claim 1, wherein the article has a pressure yielding point at a hardness of about 61 HRC of higher than about 2,700 MPa.

12. The article of claim 3, wherein the article, when subjected to a heat treatment to a hardness of about 64 HRC, has an impact strength at room temperature of higher than about 80 J.

13. The article of claim 5, wherein the article, when subjected to a heat treatment to a hardness of about 64 HRC, has an impact strength at room temperature of higher than about 100 J.

14. The article of claim 9, wherein the article, when subjected to a heat treatment to a hardness of about 64 HRC, has an impact strength at room temperature of higher than about 100 J.

15. The article of claim 1, wherein the powder metallurgical process comprises atomizing the melt with nitrogen to produce a metal powder having a powder grain size of not larger than about 500 μm.

16. The article of claim 15, wherein the powder metallurgical process further comprises placing the metal powder into a vessel while avoiding oxygen admission, closing the vessel and hot isostatically pressing the metal powder in the closed vessel to produce a blank.

17. The article of claim 16, wherein the process further comprises a hot forming of the blank.

18. A process for producing a cold work steel article, which process comprises making a blank of a metal material by a powder metallurgical process and converting the blank into the article, wherein the metal material comprises, in % by weight:

| | |
|---|---|
| Carbon | from more than about 0.6 to less than about 1.0 |
| Silicon | from more than about 0.3 to less than about 0.85 |
| Manganese | from more than about 0.2 to less than about 1.5 |
| Phosphorus | from 0 to about 0.03 |
| Sulfur | from 0 to less than about 0.5 |
| Chromium | from more than about 4.0 to less than about 6.2 |
| Molybdenum | from more than about 1.9 to less than about 3.8 |
| Nickel | from 0 to less than about 0.9 |
| Vanadium | from more than about 1.0 to less than about 2.9 |
| Tungsten | from more than about 1.8 to less than about 3.4 |
| Copper | from 0 to less than about 0.7 |
| Cobalt | from more than about 3.8 to less than about 5.8 |
| Aluminum | from 0 to less than about 0.065 |
| Nitrogen | from 0 to less than about 0.2 |
| Oxygen | from 0 to about 0.012 |

the balance being iron and accompanying and impurity elements due to smelting.

19. The process of claim 18, wherein the metal material comprises:

| | |
|---|---|
| Carbon | from more than about 0.75 to less than about 0.94 |
| Silicon | from more than about 0.35 to less than about 0.7 |
| Manganese | from more than about 0.25 to less than about 0.9 |
| Phosphorus | from 0 to about 0.025 |
| Sulfur | from 0 to less than about 0.34 |
| Chromium | from more than about 4.0 to less than about 6.2 |
| Molybdenum | from more than about 2.2 to less than about 3.4 |
| Nickel | from 0 to less than about 0.5 |
| Vanadium | from more than about 1.5 to less than about 2.6 |
| Tungsten | from more than about 2.0 to less than about 3.0 |
| Copper | from 0 to less than about 0.45 |
| Cobalt | from more than about 4.0 to less than about 5.0 |
| Aluminum | from 0 to less than about 0.05 |
| Nitrogen | from more than about 0.01 to less than about 0.1 |
| Oxygen | from 0 to about 0.010. |

20. The process of claim 18, wherein the article, when subjected to a heat treatment to a hardness of about 64 HRC, has an impact strength at room temperature of higher than about 80 J.

21. The process of claim 20, wherein the article has a pressure yielding point at a hardness of about 61 HRC of higher than about 2,700 MPa.

22. The process of claim 20, wherein impurity elements in the material are present in the following concentrations, in % by weight:

| | |
|---|---|
| Tin | 0 to not more than about 0.02 |
| Antimony | 0 to not more than about 0.022 |
| Arsenic | 0 to not more than about 0.03 |
| Selenium | 0 to not more than about 0.012 |
| Bismuth | 0 to not more than about 0.01. |

23. The process of claim 18, wherein the powder metallurgical process comprises atomizing the melt with nitrogen to produce a metal powder having a powder grain size of not larger than about 500 μm.

24. The process of claim 23, wherein the powder metallurgical process further comprises placing the metal powder into a vessel while avoiding oxygen admission, closing the vessel and hot isostatically pressing the metal powder in the closed vessel to produce the blank.

25. The process of claim 18, wherein the process comprises a hot forming of the blank.

26. The process of claim 23, wherein the nitrogen for atomizing the melt is of high purity.

27. The process of claim 24, wherein the material comprises

| | |
|---|---|
| Carbon | from more than about 0.8 to less than about 0.9 |
| Silicon | from more than about 0.4 to less than about 0.65 |
| Manganese | from more than about 0.3 to less than about 0.5 |
| Phosphorus | from 0 to about 0.025 |
| Sulfur | from 0 to about 0.025 |
| Chromium | from more than about 4.1 to less than about 4.5 |
| Molybdenum | from more than about 2.5 to less than about 3.0 |
| Nickel | from 0 to less than about 0.5 |
| Vanadium | from more than about 1.8 to less than about 2.4 |
| Tungsten | from more than about 2.0 to less than about 3.0 |
| Copper | from 0 to about 0.3 |
| Cobalt | from more than about 4.2 to less than about 4.8 |

-continued

| | |
|---|---|
| Aluminum | from more than about 0.01 to less than about 0.045 |
| Nitrogen | from more than about 0.05 to less than about 0.08 |
| Oxygen | from 0 to about 0.009. |

28. A metal material for producing a cold work steel article by a powder metallurgical process, which material comprises, in % by weight:

| | |
|---|---|
| Carbon | from more than about 0.6 to less than about 1.0 |
| Silicon | from more than about 0.3 to less than about 0.85 |
| Manganese | from more than about 0.2 to less than about 1.5 |
| Phosphorus | from 0 to about 0.03 |
| Sulfur | from 0 to less than about 0.5 |
| Chromium | from more than about 4.0 to less than about 6.2 |
| Molybdenum | from more than about 1.9 to less than about 3.8 |
| Nickel | from 0 to less than about 0.9 |
| Vanadium | from more than about 1.0 to less than about 2.9 |
| Tungsten | from more than about 1.8 to less than about 3.4 |
| Copper | from 0 to less than about 0.7 |
| Cobalt | from more than about 3.8 to less than about 5.8 |
| Aluminum | from 0 to less than about 0.065 |
| Nitrogen | from 0 to less than about 0.2 |
| Oxygen | from 0 to about 0.012 |

the balance being iron and accompanying and impurity elements due to smelting.

29. The material of claim 28, wherein one or more elements in the material are present in the following concentrations:

| | |
|---|---|
| Carbon | from more than about 0.75 to less than about 0.94 |
| Silicon | from more than about 0.35 to less than about 0.7 |
| Manganese | from more than about 0.25 to less than about 0.9 |
| Phosphorus | from 0 to about 0.025 |
| Sulfur | from 0 to less than about 0.34 |
| Chromium | from more than about 4.0 to less than about 6.2 |
| Molybdenum | from more than about 2.2 to less than about 3.4 |
| Nickel | from 0 to less than about 0.5 |
| Vanadium | from more than about 1.5 to less than about 2.6 |
| Tungsten | from more than about 2.0 to less than about 3.0 |
| Copper | from 0 to less than about 0.45 |
| Cobalt | from more than about 4.0 to less than about 5.0 |
| Aluminum | from 0 to less than about 0.05 |
| Nitrogen | from more than about 0.01 to less than about 0.1 |
| Oxygen | from 0 to about 0.010. |

30. The material of claim 28, wherein the elements in the material are present in the following concentrations:

| | |
|---|---|
| Carbon | from more than about 0.75 to less than about 0.94 |
| Silicon | from more than about 0.35 to less than about 0.7 |
| Manganese | from more than about 0.25 to less than about 0.9 |
| Phosphorus | from 0 to about 0.025 |
| Sulfur | from 0 to less than about 0.34 |
| Chromium | from more than about 4.0 to less than about 6.2 |
| Molybdenum | from more than about 2.2 to less than about 3.4 |
| Nickel | from 0 to less than about 0.5 |
| Vanadium | from more than about 1.5 to less than about 2.6 |
| Tungsten | from more than about 2.0 to less than about 3.0 |
| Copper | from 0 to less than about 0.45 |
| Cobalt | from more than about 4.0 to less than about 5.0 |
| Aluminum | from 0 to less than about 0.05 |
| Nitrogen | from more than about 0.01 to less than about 0.1 |
| Oxygen | from 0 to about 0.010. |

31. The material of claim 30, wherein one or more elements in the material are present in the following concentrations:

| | |
|---|---|
| Carbon | from more than about 0.8 to less than about 0.9 |
| Silicon | from more than about 0.4 to less than about 0.65 |
| Manganese | from more than about 0.3 to less than about 0.5 |
| Sulfur | from 0 to about 0.025 |
| Chromium | from more than about 4.1 to less than about 4.5 |
| Molybdenum | from more than about 2.5 to less than about 3.0 |
| Vanadium | from more than about 1.8 to less than about 2.4 |
| Copper | from 0 to about 0.3 |
| Cobalt | from more than about 4.2 to less than about 4.8 |
| Aluminum | from more than about 0.01 to less than about 0.045 |
| Nitrogen | from more than about 0.05 to less than about 0.08 |
| Oxygen | from 0 to about 0.009. |

32. The material of claim 28, wherein the elements in the material are present in the following concentrations:

| | |
|---|---|
| Carbon | from more than about 0.8 to less than about 0.9 |
| Silicon | from more than about 0.4 to less than about 0.65 |
| Manganese | from more than about 0.3 to less than about 0.5 |
| Phosphorus | from 0 to about 0.025 |
| Sulfur | from 0 to about 0.025 |
| Chromium | from more than about 4.1 to less than about 4.5 |
| Molybdenum | from more than about 2.5 to less than about 3.0 |
| Nickel | from 0 to less than about 0.5 |
| Vanadium | from more than about 1.8 to less than about 2.4 |
| Tungsten | from more than about 2.0 to less than about 3.0 |
| Copper | from 0 to about 0.3 |
| Cobalt | from more than about 4.2 to less than about 4.8 |
| Aluminum | from more than about 0.01 to less than about 0.045 |
| Nitrogen | from more than about 0.05 to less than about 0.08 |
| Oxygen | from 0 to about 0.009. |

33. The material of claim 28, wherein one or more impurity elements in the material are present in the following concentrations in % by weight:

| | |
|---|---|
| Tin | 0 to not more than about 0.02 |
| Antimony | 0 to not more than about 0.022 |
| Arsenic | 0 to not more than about 0.03 |
| Selenium | 0 to not more than about 0.012 |
| Bismuth | 0 to not more than about 0.01. |

34. The material of claim 32, wherein impurity elements in the material are present in the following concentrations in % by weight:

| | |
|---|---|
| Tin | 0 to not more than about 0.02 |
| Antimony | 0 to not more than about 0.022 |
| Arsenic | 0 to not more than about 0.03 |
| Selenium | 0 to not more than about 0.012 |
| Bismuth | 0 to not more than about 0.01. |

35. The material of claim 31, wherein the material, when subjected to a heat treatment to a hardness of about 64 HRC, has an impact strength at room temperature of higher than about 100 J.

36. A metal powder which comprises the material of claim 28.

37. The metal powder of claim 36, wherein the metal powder has a powder grain size of not larger than about 500 μm.

38. The metal powder of claim 37, wherein the metal powder has been produced by atomization of a metal melt with an inert gas.

39. The metal powder of claim 38, wherein the inert gas comprises nitrogen.

* * * * *

UNITED STATES PATENT AND TRADEMARK OFFICE

CERTIFICATE OF CORRECTION

PATENT NO. : 7,682,417 B2
APPLICATION NO. : 10/830003
DATED : March 23, 2010
INVENTOR(S) : Schemmel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1647 days.

Signed and Sealed this
Eighth Day of February, 2011

David J. Kappos

David J. Kappos
*Director of the United States Patent and Trademark Office*